United States Patent [19]

Mizunuma

[11] 4,369,847

[45] Jan. 25, 1983

[54] BLADE ASSEMBLY

[75] Inventor: Wataru Mizunuma, Sagamihara, Japan

[73] Assignee: Mitsubishi Jukogyo Kabushiki Kaisha, Tokyo, Japan

[21] Appl. No.: 215,926

[22] Filed: Dec. 12, 1980

[30] Foreign Application Priority Data

Jan. 30, 1980 [JP] Japan ..... 55-9815[U]

[51] Int. Cl.[3] ..... E02F 3/76

[52] U.S. Cl. ..... 172/815; 172/701.1

[58] Field of Search ..... 172/815, 736, 741, 783, 172/784, 819, 701.1, 701.2, 701.3; 30/272 A, 172, 287, 379, 379.5, 304

[56] References Cited

U.S. PATENT DOCUMENTS 2,218,512 10/1940 Ball ..... 172/819
3,316,636 5/1967 Raper ..... 30/272 A
3,646,675 3/1972 Wezel ..... 30/272 A
3,703,210 11/1972 Williams ..... 172/784

FOREIGN PATENT DOCUMENTS 2409027 9/1975 Fed. Rep. of Germany ..... 172/815
1015307 12/1965 United Kingdom ..... 172/736

*Primary Examiner*—Richard J. Johnson
*Attorney, Agent, or Firm*—Wenderoth, Lind & Ponack

[57] ABSTRACT

An improved blade assembly is of the type that a blade length is made variable by sliding an auxiliary blade or blades along a main blade. Cutting edge portions of the main blade and the auxiliary blade are disposed in a back-to-back relation and the directions of the tapered surfaces of the respective edge portions are inclined upwardly and outwardly from opposite sides of the complementary sliding surfaces between the main and auxiliary blades so that the knife edges of the respective edge portions may be aligned substantially on the same straight line.

1 Claim, 5 Drawing Figures

BLADE ASSEMBLY

BACKGROUND OF THE INVENTION

The present invention relates to a blade assembly to be equipped on a motorized grader or the like.

A blade assembly illustrated in FIG. 1 is constructed in such manner than an auxiliary blade b is laterally extended from a main blade a by sliding the auxiliary blade b along the main blade a as a result of extension and contraction operations of a hydraulic cylinder c, thereby to vary the blade length. In the case where an edge portion d of the movable auxiliary blade b and an edge portion f of a cutting edge e of the main blade a are tapered in the same direction as shown in FIG. 1, although no problem arises in varying the blade length, the knife edges of the movable auxiliary blade b and the cutting edge e do not align on the same straight line but a step is formed therebetween. Hence, when the blade assembly is tilted (when the scraping angle is varied), a step is formed on a finished surface after the blade working operation, so that an adverse effect results.

SUMMARY OF THE INVENTION

It is therefore one object of the present invention to provide a novel blade assembly which is free from the above-mentioned disadvantges, and which can continuously vary the blade length while avoiding degradation of precision in finishing.

According to one feature of the present invention, there is provided a blade assembly for construction equipment or vehicles of the type wherein a blade length is made variable by sliding an auxiliary blade or blades along a main blade, in which cutting edge portions of the main blade and the auxiliary blade, respectively, are disposed in a back-to-back relation and the directions of the tapered surfaces of the respective edge portions are inclined away in opposite direction from the sliding surface between the main and auxiliary blades so that the knife edges of the respective edge portions are aligned substantially on the same straight line.

BRIEF DESCRIPTION OF THE DRAWINGS

The above-mentioned and other features and objects of the present invention will become more apparent by reference to the following description of a preferred embodiment of the invention taken in conjunction with the accompanying drawings, wherein.

DETAILED DESCRIPTION OF THE INVENTION

Figure 1:
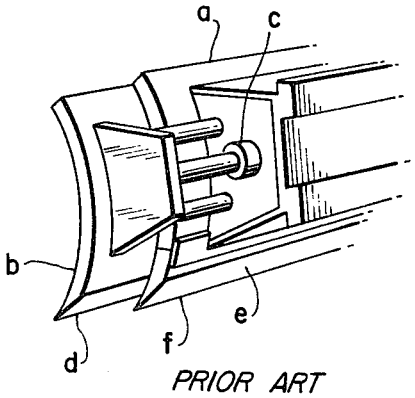
PRIOR ART FIG. 1
FIG. 1 is a rear perspective view of a blade assembly according to the prior art.
Figure 2:
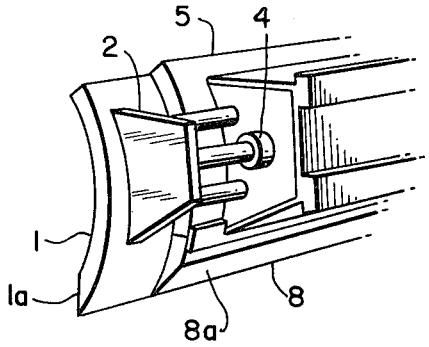
FIG. 2 is a similar rear perspective view showing one preferred embodiment of the present invention.
Figure 3:
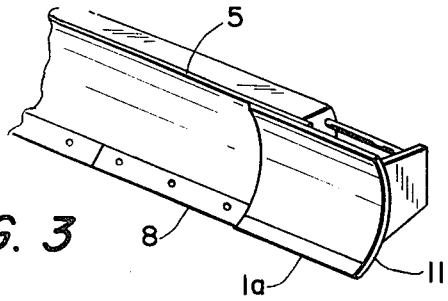
FIG. 3 is a front perspective view of the same embodiment.

In FIGS. 2–5 of the drawings, reference numeral 1 designates a curved movable auxiliary blade which can slide laterally along a curved main blade 5, numeral 2 designates a guide plate formed as projecting backwardly from the movable auxiliary blade 1, numeral 3 designates guide rods, and numeral 4 designates a hydraulic cylinder. Reference numerals 6 and 7 are guide brackets fixedly interposed between the main blade 5 and a blade support 9 for the main blade 5, and guide holes for slidably guiding the guide rods 3 are drilled in the guide brackets 6 and 7. First ends of the guide rods 3 are fixedly connected to the guide plate 2, and one end (on the rod side) of the hydraulic cylinder 4 is also pivotably connected to the guide plate 2. The other end of the hydraulic cylinder 4 is pivotably connected to the blade support 9, so that as a result of extension and contraction operations of the hydraulic cylinder 4, the movable auxiliary blade 1 is made to slide laterally along the front surface of the main blade 5 so as to extend sidewards from the main blade 5. The main and auxiliary blades and their complementary sliding surfaces are curved about a common axis extending generally parallel said same straight line. Reference numeral 8 designates a cutting edge mounted on the main blade 5, and numeral 10 designates a guide bracket for making the main blade slide laterally therealong.

Figure 4:
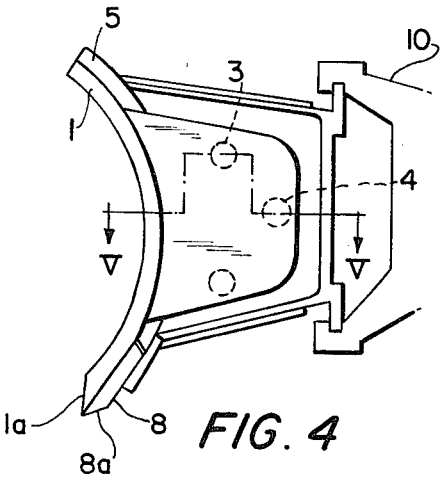
FIG. 4 is a side view of the same.
Figure 5:
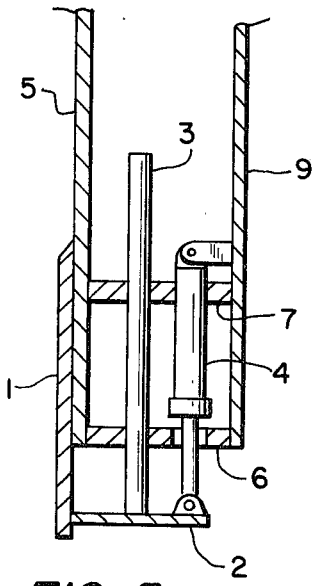
FIG. 5 is a horizontal cross-sectional view taken along line V—V in FIG. 4.

Reference numeral 1*a* designates an edge portion of the movable auxiliary blade 1, numeral 8*a* designates a tapered knife surface (edge portion) of the cutting edge 8, and these edge portions 1*a*, 8*a* are disposed in a back-to-back relation with the directions of their tapered surfaces taken on the opposite sides of the curved complementary sliding surfaces between the main and auxiliary blades 5 and 1 so that the knife edges of the respective edge portions may be aligned substantially on the same straight line, as shown in the drawings (especially, refer to FIG. 4).

In the blade assembly according to the present invention which is constructed as described above, as a result of extension and contraction operations of the hydraulic cylinder 4 the movable auxiliary blade 1 slides laterally along the main blade 5. At this moment, since the edge portion 1*a* of the movable auxiliary blade 1 and the edge portion 8*a* of the cutting edge 8 have their tapered surfaces located in a back-to-back relation, it is possible to continuously vary the blade length while the knife edges of the respective edge portion are kept aligned on the same straight line over the entire blade length. Since the knife edges of the edge portions 1*a* and 8*a* always align on the same straight line even if the blade length is varied by the extension and contraction operations of the hydraulic cylinder as described above, variations of the blade length will not result in degradation of finishing precision in the blade working operation, and hence a clear finished earth surface can be obtained.

As described above, according to the present invention, in a blade assembly for construction equipment or vehicles, a blade length is made variable by sliding an auxiliary blade or blades along a main blade, with cutting edge portions of the main blade and the auxiliary blade being disposed in a back-to-back relation with the directions of the tapered surfaces of the respective edge portions extending from opposite sides of the curved sliding surfaces between the main and auxiliary blades. Thus the knife edges of the respective edge portions may be aligned substantially on the same straight line, even when the blade length is varied continuously. Therefore, degradation of finishing precision (uneven finished surface or finished surface having steps) will not occur, and the efficiency of working with the blade assembly will be enhanced.

Since many changes could be made to the above construction and many apparently widely different embodiments of this invention could be made without departing the scope thereof, it is intended that all matter contained in the above description or shown in the drawings shall be interpreted as illustrative and not as a limitation to the scope of the invention.

What is claimed is:

1. A blade assembly for use on grader or construction vehicles, said blade assembly comprising:

a main blade adapted to be mounted on a vehicle;

at least one auxiliary blade mounted on the end of said main blade; and means for varying the total blade width of the assembly by sliding said auxiliary blade laterally with respect to said main blade along respective complementary sliding surfaces of said main and auxiliary blades;

said main and auxiliary blades having respective lower edge portions defined by respective tapered surfaces forming respective lower knife edges, said edge portions being positioned in back-to-back relation, said respective tapered surfaces converging downwardly and being inclined upwardly in opposite directions away from said complementary sliding surfaces, and said respective knife edges being aligned in the same straight line;

said main and auxiliary blades-and said respective complementary surfaces thereof being curved about a common axis extending generally parallel said same straight line.

* * * * *